US005988406A

United States Patent [19]

Leipziger

[11] Patent Number: 5,988,406

[45] Date of Patent: Nov. 23, 1999

[54] DISHWASHER RETAINER NET

[76] Inventor: David Leipziger, 2011 A Pepperstone Pl., Greensboro, N.C. 27406

[21] Appl. No.: 09/019,284

[22] Filed: Feb. 5, 1998

[51] Int. Cl.[6] ..... A47G 19/08

[52] U.S. Cl. ..... 211/41.9

[58] Field of Search ..... 211/41.9; 248/680, 248/500, 505, 510

[56] References Cited

U.S. PATENT DOCUMENTS

D. 338,750 8/1993 Chandler .
4,974,806 12/1990 Matern ..... 248/499
5,114,019 5/1992 Sandbank ..... 211/41.9
5,121,843 6/1992 Elder ..... 211/41.9
5,294,008 3/1994 Dunaway ..... 211/41.9

*Primary Examiner*—Alvin Chin-Shue
*Assistant Examiner*—Sarah Purol

[57] ABSTRACT

A dishwasher retaining net is provided including a net having a plurality of cords integrally coupled to define a plurality of free ends. A plurality of hook units are each fixedly coupled to an associated one of the free ends of the net. By this structure, the hooks are adapted to releasably engage a dishwasher rack such that the net encompasses dishes within the dishwasher rack for maintaining the orientation thereof.

5 Claims, 2 Drawing Sheets

DISHWASHER RETAINER NET

BACKGROUND OF THE INVENTION

1. Field of the Invention

The present invention relates to dish retainers and more particularly pertains to a new dishwasher retainer net for maintaining dishes within a dishwasher in a stationary orientation.

2. Description of the Prior Art

The use of dish retainers is known in the prior art. More specifically, dish retainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art dish retainers include U.S. Pat. No. 5,294,008; U.S. Pat. No. 5,121,843; U.S. Pat. Des. No. 338,750; U.S. Pat. No. 5,201,826; U.S. Pat. No. 5,114,019; and U.S. Pat. No. 4,974,806.

In these respects, the dishwasher retainer net according to the present invention substantially departs from the conventional concepts and designs of the prior art, and in so doing provides an apparatus primarily developed for the purpose of maintaining dishes within a dishwasher in a stationary orientation.

SUMMARY OF THE INVENTION

In view of the foregoing disadvantages inherent in the known types of dish retainers now present in the prior art, the present invention provides a new dishwasher retainer net construction wherein the same can be utilized for maintaining dishes within a dishwasher in a stationary orientation.

The general purpose of the present invention, which will be described subsequently in greater detail, is to provide a new dishwasher retainer net apparatus and method which has many of the advantages of the dish retainers mentioned heretofore and many novel features that result in a new dishwasher retainer net which is not anticipated, rendered obvious, suggested, or even implied by any of the prior art dish retainers, either alone or in any combination thereof.

To attain this, the present invention generally comprises a dishwasher rack formed of a plurality of rigid rods defining a bottom face and a periphery having an upper peripheral edge. The dishwasher rack has a plurality of dishes situated therein. As shown in FIG. 3, a net is provided including a plurality of flexible elastic cords integrally coupled in perpendicular relationship to define a consistent matrix of squares. Also defined is a plurality of free ends each having a knot formed therein. Finally, a plurality of hook units each include a retainer having a frusto-conical configuration. Such retainer is equipped with an open inboard end with a first diameter and an open outboard end with a second diameter greater than the first diameter and defining a peripheral edge. Each hook unit further includes a J-shaped hook coupled to the peripheral edge of the retainer and extending outwardly therefrom. By this structure, the retainer is adapted to encompass the knot of an associated free end of the net thereby remaining in fixed relation therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dishwasher retainer net apparatus and method which has many of the advantages of the dish retainers mentioned heretofore and many novel features that result in a new dishwasher retainer net which is not anticipated, rendered obvious, suggested, or even implied by any of the prior art dish retainers, either alone or in any combination thereof.

It is another object of the present invention to provide a new dishwasher retainer net which may be easily and efficiently manufactured and marketed.

It is a further object of the present invention to provide a new dishwasher retainer net which is of a durable and reliable construction.

An even further object of the present invention is to provide a new dishwasher retainer net which is susceptible of a low cost of manufacture with regard to both materials and labor, and which accordingly is then susceptible of low prices of sale to the consuming public, thereby making such dishwasher retainer net economically available to the buying public.

Still yet another object of the present invention is to provide a new dishwasher retainer net which provides in the apparatuses and methods of the prior art some of the advantages thereof, while simultaneously overcoming some of the disadvantages normally associated therewith.

Still another object of the present invention is to provide a new dishwasher retainer net for maintaining dishes within a dishwasher in a stationary orientation.

Even still another object of the present invention is to provide a new dishwasher retainer net that includes a net having a plurality of cords integrally coupled to define a plurality of free ends. A plurality of hook units are each fixedly coupled to an associated one of the free ends of the net. By this structure, the hooks are adapted to releasably engage a dishwasher rack such that the net encompasses dishes within the dishwasher rack for maintaining the orientation thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
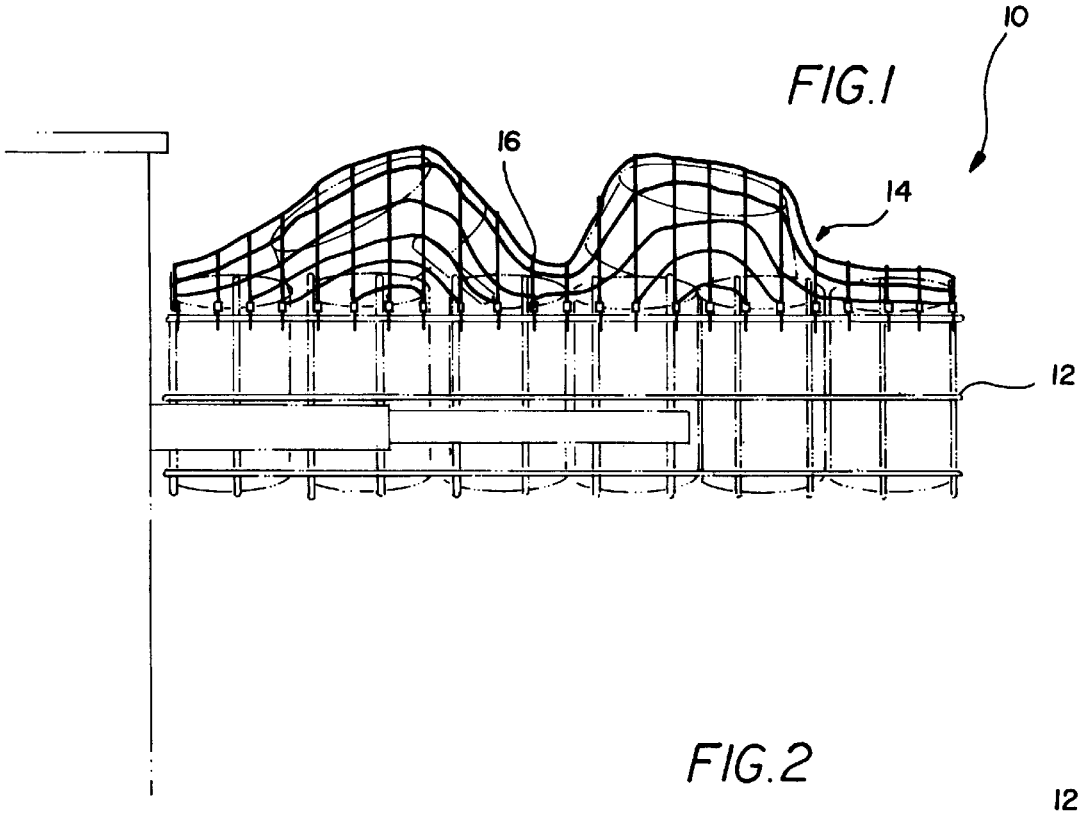
FIG. 1 is a side view of a new dishwasher retainer net according to the present invention.
Figure 2:
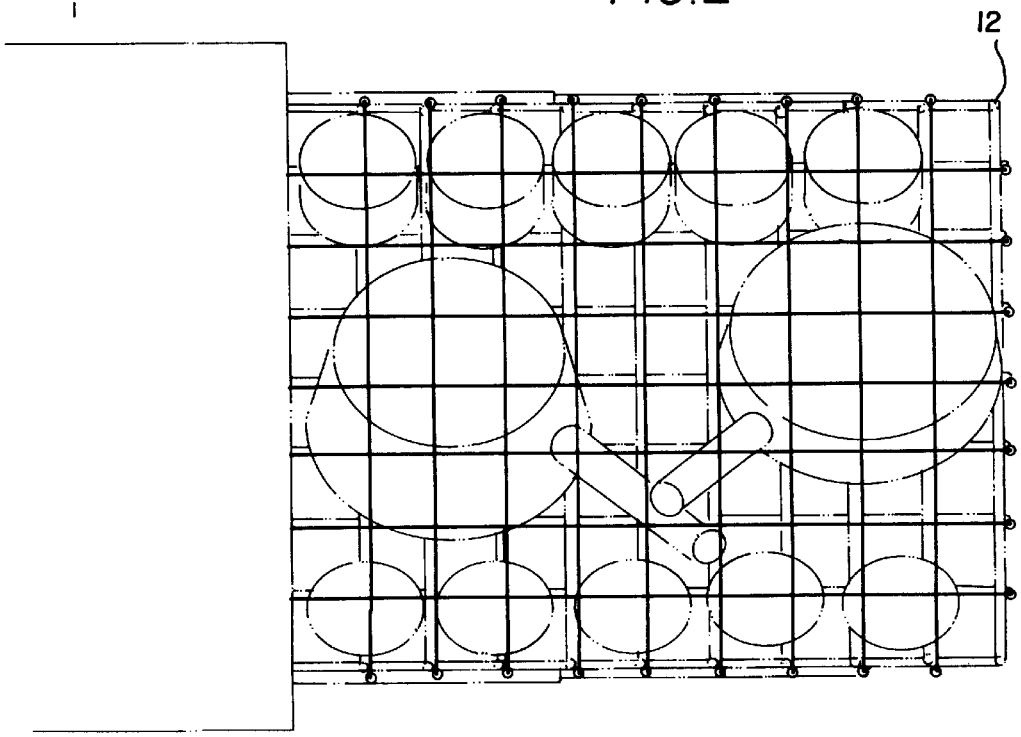
FIG. 2 is a top view of the present invention.

With reference now to the drawings, and in particular to FIGS. 1 through 4 thereof, a new dishwasher retainer net embodying the principles and concepts of the present invention and generally designated by the reference numeral 10 will be described.

The present invention, designated as numeral 10, includes a dishwasher rack 12 formed of a plurality of rigid rods defining a bottom face and a periphery having an upper peripheral edge. The dishwasher rack has a plurality of dishes situated therein.

Figure 3:
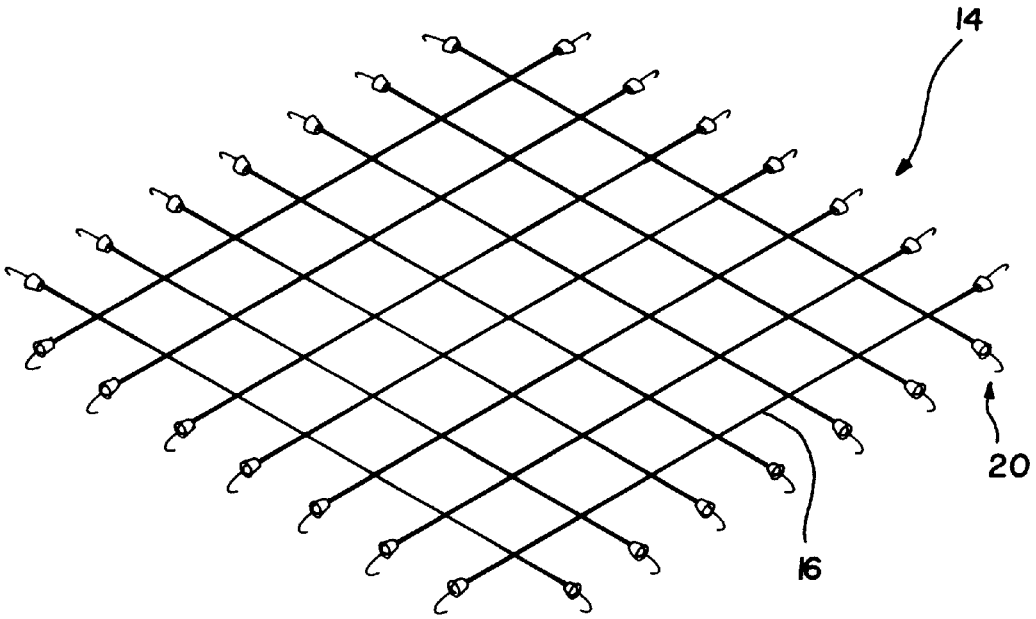
FIG. 3 is a perspective view of the present invention.

As shown in FIG. 3, a net 14 is provided including a plurality of flexible elastic cords 16 integrally coupled in perpendicular relationship to define a consistent matrix of squares. Also defined is a plurality of free ends 18 each having a knot formed therein. As shown in FIG. 3, each of the free ends has a length equal to a side of one of the squares.

Figure 4:
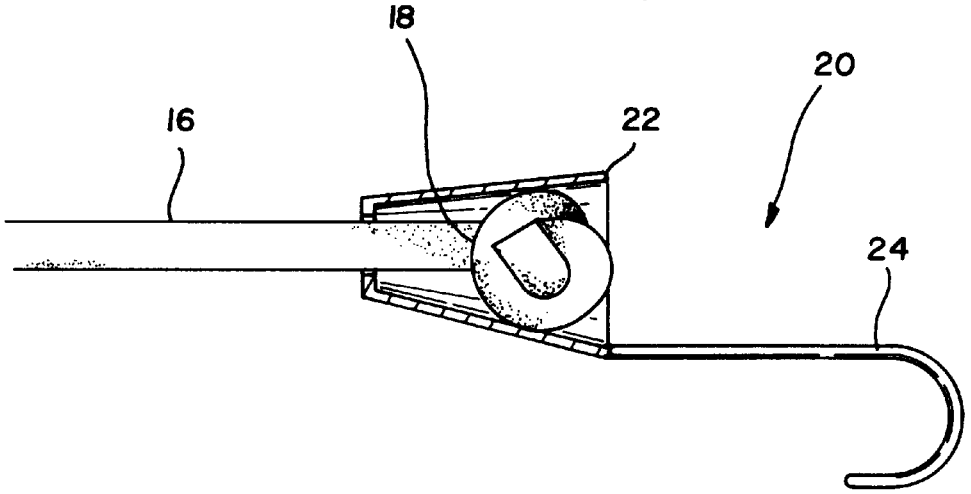
FIG. 4 is a side cross-sectional view of one of the hook units of the present invention.

Finally, a plurality of hook units 20 each include a retainer 22 having an inner and outer surface with a frusto-conical configuration. Such retainer is equipped with an open inboard end with a first diameter and an open outboard end with a second diameter greater than the first diameter and defining a peripheral edge. Each hook unit further includes a J-shaped hook 24 integrally coupled to the peripheral edge of the retainer and extending outwardly therefrom. As shown in FIG. 4, a linear extent of the hook extends a length equal to that of the retainer. Further, such linear extent remains in parallel with an axis of the retainer. Finally, it should be noted that the hook portion extends outwardly away from the aforementioned axis.

By this structure, the retainer is adapted to encompass the knot of an associated free end of the net thereby remaining in fixed relation therewith. In use, the hooks are adapted to releasably engage the upper peripheral edge of the dishwasher rack such that the net conforms to the dishes for maintaining the orientation thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dishwasher retaining net comprising, in combination:

a dishwasher rack formed of a plurality of rigid rods defining a bottom face and a periphery having an upper peripheral edge, the dishwasher rack having a plurality of dishes situated therein;

a net including a plurality of flexible elastic cords integrally coupled in perpendicular relationship to define a consistent matrix of squares and a plurality of free ends each having a knot formed therein; and a plurality of hook units each including a generally hollow retainer having a frusto-conical configuration with an open inboard end with a first diameter, an open outboard end with a second diameter and a retainer wall extending between said inboard end and said outboard end to define an interior retainer space, said second diameter being greater than the first diameter and defining a peripheral edge, each hook unit further including a J-shaped hook coupled to the peripheral edge of the retainer and extending outwardly therefrom, the retainer being adapted to encompass the knot of an associated free end of the net, said open inboard end having an annular lip for engaging said knot for preventing said free end from passing through said open inboard end thereby coupling said retainer to said free end;

whereby the hooks are adapted to releasably engage the upper peripheral edge of the dishwasher rack such that the net conforms to the dishes for maintaining the orientation thereof.

2. A dishwasher retaining net comprising, in combination:

a dishwasher rack formed of a plurality of rigid rods defining a bottom face and a periphery, the dishwasher rack having a plurality of dishes situated therein;

a net including a plurality of cords integrally coupled to define a plurality of free ends; and a plurality of hook units, each hook unit having a frusto-conical retainer having an open inboard end, an open outboard end, and a retainer wall extending between the inboard end and the outboard end to define an interior retainer space, each hook unit further having a hook extending from a peripheral edge of said outboard end, each inboard end further having an annular lip extending inwardly for engaging an associated free end of the net whereby each hook unit is coupled to an associated one of the free ends of the net;

whereby the hook units are adapted to releasably engage the dishwasher rack such that the net encompasses the dishes for maintaining the orientation thereof.

3. A dishwasher retaining net as set forth in claim 2 wherein each hook unit has a J-shaped hook.

4. A dishwasher retaining net as set forth in claim 2 wherein the cords of the net are elastic and flexible and the net is adapted to conform to the dishes for maintaining the orientation thereof.

5. A dishwasher retaining net as set forth in claim 2 wherein the cords of the net are coupled in perpendicular relationship.

* * * * *